US005314393A

United States Patent [19]

Rubin et al.

[11] Patent Number: 5,314,393

[45] Date of Patent: May 24, 1994

[54] WATER JUMP ROPE

[76] Inventors: Arnold Rubin, 17437 Palora St., Encino, Calif. 91316; Michael J. Poulin, 6686 Tenth Line West, Mississauga, Ontario, Canada, L5N 5L4

[21] Appl. No.: 940,066

[22] Filed: Sep. 3, 1992

[51] Int. Cl.[5] ..... A63B 5/20

[52] U.S. Cl. ..... 482/82; 442/148; 472/13

[58] Field of Search ..... 482/81, 82, 148; 472/13, 128, 33

[56] References Cited

U.S. PATENT DOCUMENTS 1,629,209 5/1927 Fairbanks ..... 482/82

3,107,916 10/1963 Cooper ..... 482/82

4,776,585 10/1988 Maleyko ..... 482/82

*Primary Examiner*—Stephen R. Crow

*Assistant Examiner*—Jerome Donnelly

*Attorney, Agent, or Firm*—Lewis Anten

[57] ABSTRACT

A jump rope, capable of being connected to a source of water, consists of a hollow tube connected from the source of water to a jump rope handle. The outlet of the jump rope handle is connected to a hollow tube that has a series of small holes. The other end of the hollow tubing have the holes is connected to a second jump rope handle. The handles freely rotate about the hollow tubes. Children using the jump rope become wet from water spraying from the holes in the jump rope as it is being used.

1 Claim, 3 Drawing Sheets

WATER JUMP ROPE

BACKGROUND

There have been a number of different forms of jump ropes. However, the traditional jump rope consists of a rope having handles at the two ends of the jump rope. The traditional toy jump ropes have basically remained unchanged in form for a great number of years.

SUMMARY OF THE INVENTION

In the present invention, a children's jump rope capable consisting of a first hollow tube connected from the source of water to a first handle, and then the outlet of the handle is connected to a second hollow tube forming the jump rope that has a series of small holes along its length. The other end of the hollow tubing have the holes is connected to a second handle. The handles freely rotate about the hollow tubes. Children using the jump rope become wet from water spraying from the holes in the jump rope as it is being used.

OBJECTS OF THE INVENTION

It is an object of the present invention to provide an improved jump rope that is fun to use.

It is another object of the present invention to provide an improved jump rope that is easy to manufacture.

These and other objects of the present invention will be apparent from a review of the accompanying drawings and specification.

DETAILED DESCRIPTION OF THE DRAWINGS

Figure 1:
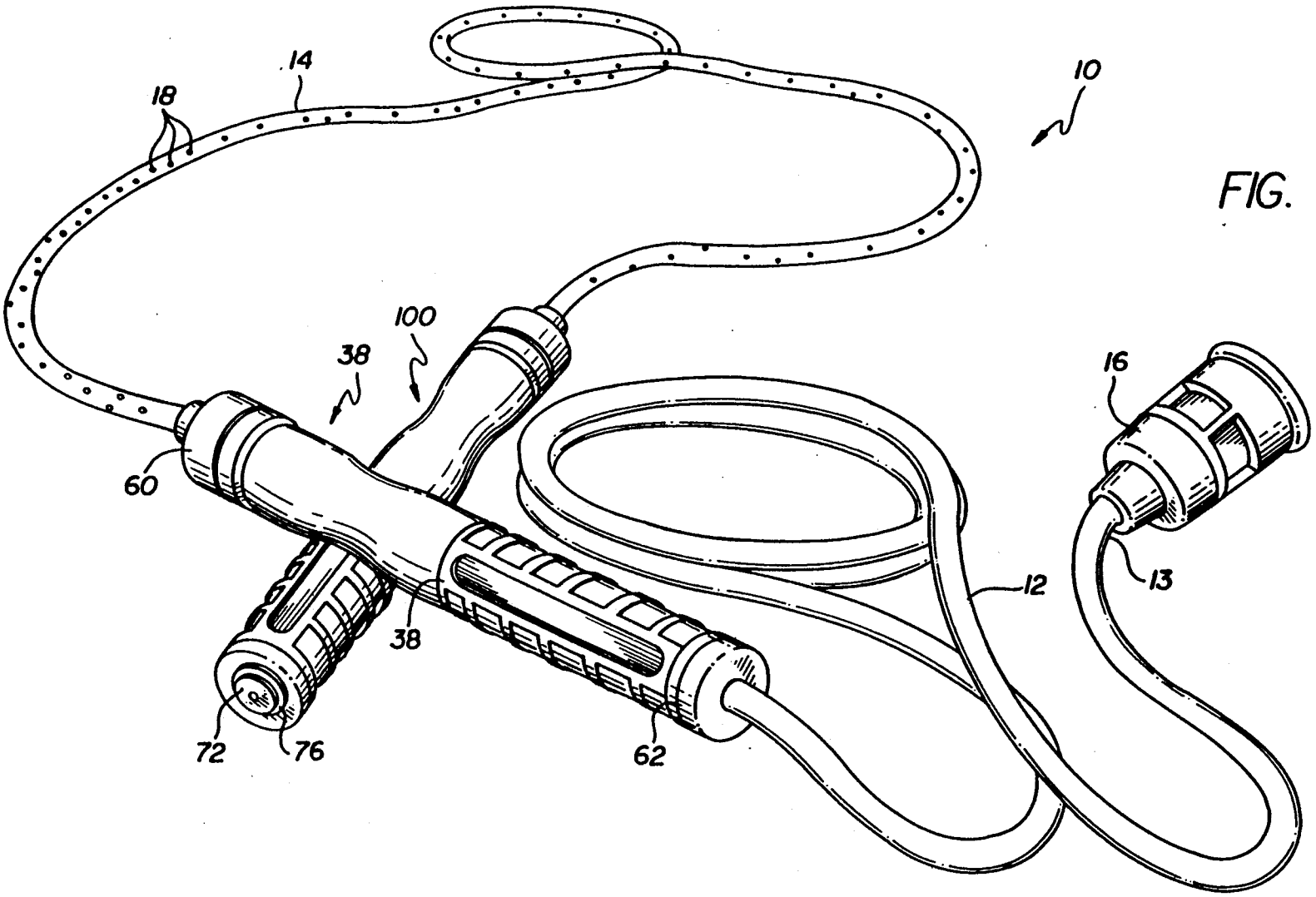
FIG. 1*a* is a perspective view of the water jump rope of the present invention.
Figure 2:
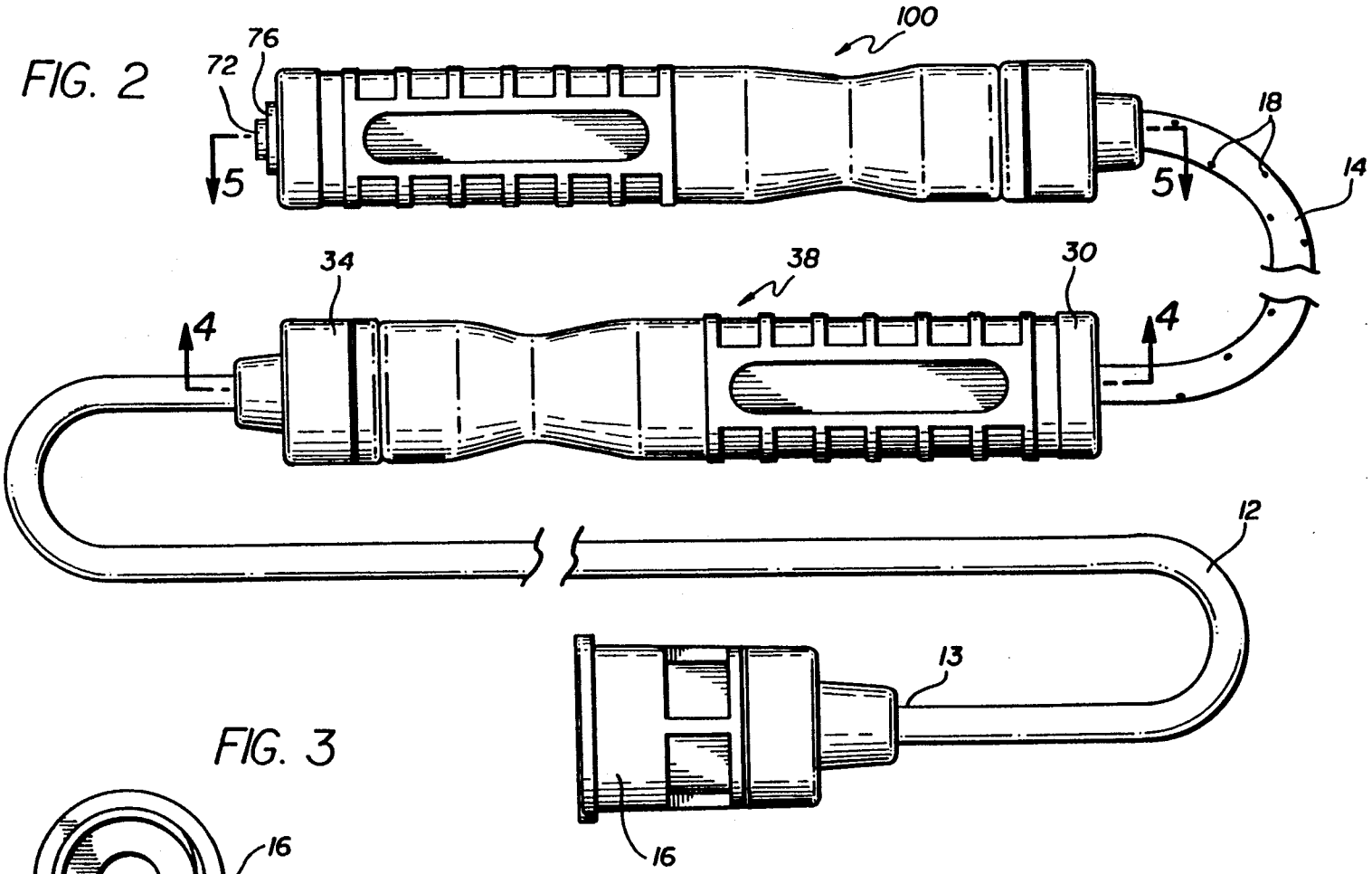
FIG. 2 is a side view of the water jump rope of the present invention.
Figure 3:
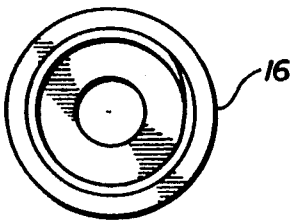
FIG. 3 is an end view of the water connector coupling.
Figure 4:
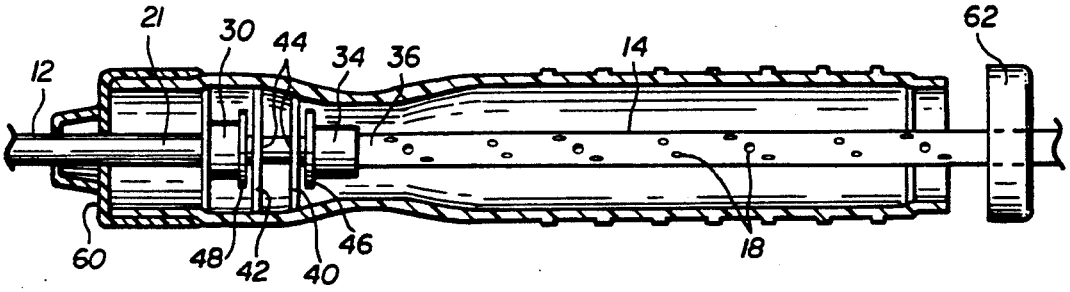
FIG. 4 is a side sectional view of handle along line 4—4 of FIG. 2.
Figure 5:
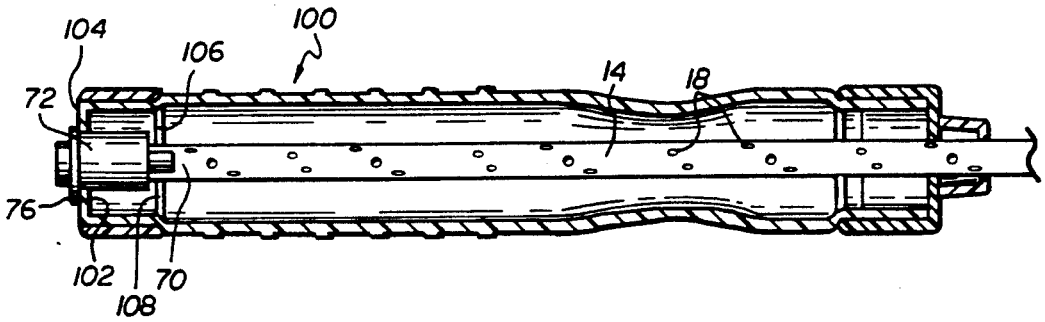
FIG. 5 is a side sectional view of the handle along lines 5—5 of FIG. 2.

Referring to the Figures the invention will be described in detail. The jump rope itself is referred to generally by numeral 10. The jump rope 10 consists of two segments of hollow flexible plastic tubing 12 and 14. The second segment 14 has a series of holes 18 along substantially its' entire length. The first segment 12 is connected at its front end 13 to a threaded connector 16 fitting 20 for connection to a faucet F or water hose not shown. The other end 21 of the first segment 12 is connected to one end 30 of a hollow coupling 32. The other end 34 of the hollow coupling 32 is connected to the first end 36 of the second segment 14.

The hollow coupling 32 is fitted within a first handle 38 formed of injection molded plastic. The first handle 38 has internal walls 40 and 42, with an opening 44 in the center of each wall permitting the hollow coupling 32 to freely pass. The hollow coupling 32 has increased diameter portions 46 and 48 to hold the hollow coupling 32 in place. Compression fittings 48 and 50 serve to assist in holding the ends 21 and 36 of the first and second segments 12 and 14 in place.

The cylindrical handle 14 has openings at both ends large enough to permit the first and second segments 12 and 14 to freely pass through the openings. Caps 60 and 62 have openings that also permit the first and second segment 12 and 14 to freely pass.

The second end 70 of second segment 14 is fitted with a closed end cap 72. The cap 72 has a portion for force fitting within the second end 70 of the second segment 14. The closed end cap 72 has an increased diameter portion 76 larger than the outside diameter of the second segment 14.

A second handle 100 has an opening 102 on one end 104 and internal projections 106 and 108 extending from the inside walls which form a compartment which surrounds the large diameter portion 76 of the cap 72 preventing lateral movement of the handle 100, but permitting rotational movement of the handle 102 relative to the second segment 14.

In the preferred embodiment of the invention, the hollow tubing segments have an outside diameter of ¼ inch and an inside diameter of ⅜ inch. The tubing is made of transparent or colored flexible polyvinyl chloride (PVC). The length of the first segment 12 is 7 ft. and the length of the second segment is 14 ft. The holes 18 in the side walls of the second segment 14 are a few thousandths of an inch, comparable to a pen hole, in diameter but can be as large as desired and are spread at irregular intervals around the entire circumference and along the entire length of the second segment 14. The holes 18 need not be within the portion of the segment within the handles.

The handles 38 and 100 have smooth outside surface and a diameter of approximately 1 inch for easy grasping by children. The handles 38 and 100 are molded in two pieces and are welded together by conventional means.

In use of the jump rope, the threaded connector 13 is attached to a source of water, such as the outdoor water faucet. The water faucet is opened permitting a flow of water to pass into the first and second segments. The water exits under pressure from the holes 18 in the second segment 14 in a spray of water. The children at each of the two handles would turn the jump rope in a conventional manner, with a child or children jumping in the middle getting wet.

While the jump rope of the present invention has been described with regard to the preferred embodiment, its recognized that the dimension can be varied. For example, the diameter and length of the segments 12 and 14 can be changed.

What is claimed is:

1. An apparatus for use as a jump rope comprising a first hollow flexible tube segment;

a second hollow flexible tube segment, said second hollow flexible tube segment having a series of openings through the walls of said second hollow flexible tube segment;

said first hollow flexible tube segment having means for connecting its first end to a source of water and its second end to the first end of said second hollow flexible tube segment;

said second hollow flexible tube segment having its second end sealed; and two handles;

the first handle surrounding the juncture between the first hollow flexible tube segment and the second hollow flexible tube segment, and the second handle surrounding said second end of said second hollow flexible tube segment and wherein said first and second hollow flexible tube segments rotate freely within said handles, as the handles are grasped and the second hollow flexible tube segment is rotated, thereby allowing the spraying of fluid over a user as the device is rotated about a user.

* * * * *